United States Patent [19]

Hazleton

[11] 4,001,753

[45] Jan. 4, 1977

[54] THERMOSTAT HAVING STABLE MOUNTING SUPPORT

[75] Inventor: Herbert T. Hazleton, Brandon, Canada

[73] Assignee: Federal Pioneer Electric Limited, Toronto, Canada

[22] Filed: July 11, 1975

[21] Appl. No.: 595,222

[30] Foreign Application Priority Data

Dec. 17, 1974 Canada ..... 216159

[52] U.S. Cl. ..... 337/380; 337/112

[51] Int. Cl.[2] ..... H01H 37/04

[58] Field of Search ..... 337/380, 381, 372, 368, 337/365, 112, 94, 82, 67, 64, 57; 200/296

[56] References Cited

UNITED STATES PATENTS

| | | | |
|---|---|---|---|
| 3,157,768 | 11/1964 | Ladd et al. | 337/380 |
| 3,629,771 | 12/1971 | Moskowitz | 337/372 |
| 3,663,916 | 5/1972 | Beck | 337/368 |
| 3,670,284 | 6/1972 | Fortier | 337/380 |

*Primary Examiner*—Harold Broome

[57] ABSTRACT

A thermostat includes a switch and an ambient temperature sensor that controls the switch. Both the switch and the ambient temperature sensor are supported by a support area of a base plate in a calibrated relationship. The base plate includes a pair of mounting strips each of which is parallel to and offset from the support area of the base plate, connected to the support area by a pair of narrow stress-isolating legs at the ends of the strip. The legs extend from integral stiffening parts of the base plate extending upright from the area of the base plate supporting the switch and the temperature sensor.

10 Claims, 3 Drawing Figures

THERMOSTAT HAVING STABLE MOUNTING SUPPORT

BACKGROUND OF THE INVENTION

This invention relates to thermostats for electric heating or cooling apparatus. The invention is discussed in connection with so-called line voltage thermostats, wherein the load current required by an electric heater or a room air conditioner is carried by the switch that forms part of the thermostat, but it applies equally to thermostats of other types or of different constructions.

A well-known type of line voltage thermostat includes an ambient temperature sensing bimetal formed of an elongated sheet or plate of sufficient width for stiffness. The bimetal element is pivotally mounted near one end from a base plate and carries an adjustment screw in its mid section which bears against the spring-loaded plunger of a snap-switch which is also carried by the base plate. A rotatable cam bears against the bimetal element near the other end in opposition to the force exerted against the screw in the bimetal element by the plunger and the spring of the switch.

The set-point temperature of the aforesaid thermostat is determined by the rotational position of the cam. Where the thermostat has an adjustment screw, it is calibrated by turning the screw into or out of the bimetal element while the plunger of the switch is spring-biased against the screw. It is usually desired to calibrate the thermostat so that the switch will be actuated when a pointer on the cam or on a knob affixed to it points upright or to a "normal" position and the temperature rises to approximately 70° F. The adjustment of the calibrating screw is usually performed by the manufacturer and then locked or cemented against further rotation.

The calibration of a thermostat usually should not be disturbed or changed after it has been adjusted and fixed. The thermostat is commonly mounted to an electrical box that is set into a wall, for this purpose using screws extending from the base plate of the thermostat to threaded ears in the box. The back or mounting plane of the thermostat is pressed against the surface of the wall when the screws are tightened. The tightening of the mounting screws for attaching the thermostat to a wall or other mounting surface can disturb its calibration by stressing and thereby physically distorting the base plate of the thermostat.

SUMMARY OF THE INVENTION

It is an object of this invention to provide a stable means for mounting thermostats and the like.

Another object of the invention is to provide means for mounting a thermostat which will not unduly stress and thereby disturb the calibration or sensitivity of the device.

Accordingly, the illustrative embodiment of this invention which is described in detail below and shown in the accompanying drawings provides novel means for mounting the thermostat. The thermostat includes a base plate having a support area for the critically related parts of the thermostat, including the bimetal element, the cam and the switch. The base plate has a pair of mounting strips for securing the thermostat to a wall box, each mounting strip being generally parallel to and offset from the support area of the base plate.

More particularly, the base plate has integral margins extending upright from opposite ends of the support area of the base plate, forming stiffening parts for the support area. The mounting strips are connected to the support area by a pair of stress-isolating legs or junctions at the ends of the strips.

DESCRIPTION OF THE PREFERRED EMBODIMENTS

Figure 1:
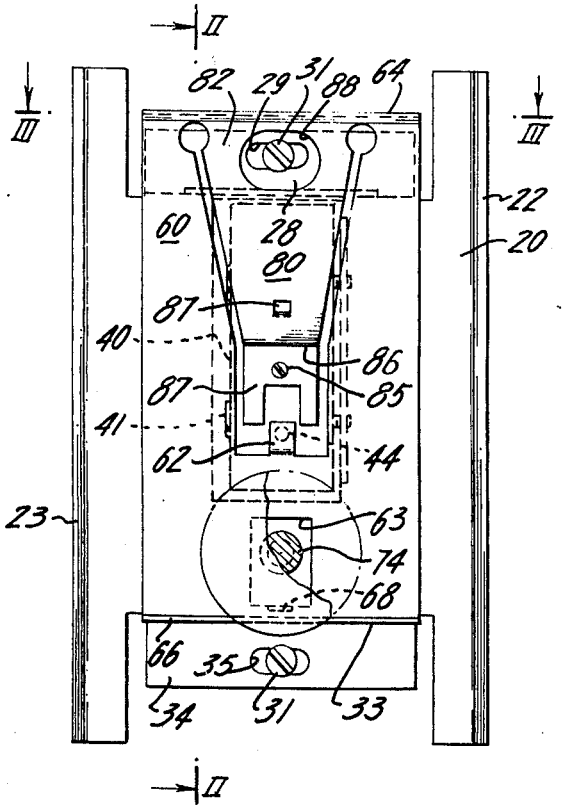
FIG. 1 is a front view of a thermostat embodying features of the invention, with the cover removed and the adjusting knob represented by dotted lines.
Figure 2:
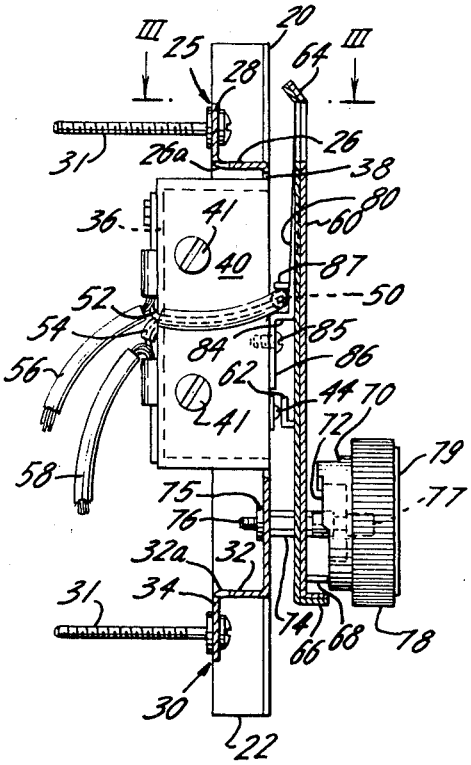
FIGS. 2 and 3 are side and top sectional views of the thermostat of FIG. 1, viewed from planes II—II and III—III therein.
Figure 3:
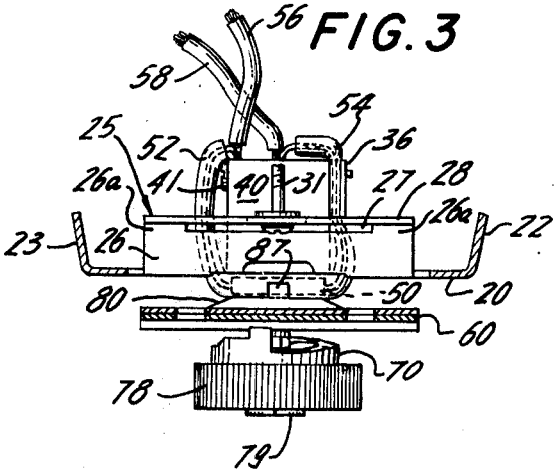

In the drawings of FIGS. 1–3, the preferred embodiment of the novel thermostat includes a base plate 20 that is formed economically of sheet metal. Alternatively, the base plate can be formed as a casting or as a molded plastic part. Base plate 20 has integral side walls 22 and 23 formed at an angle therefrom and a support member 25 which includes a wall 26 perpendicular to the front of the base plate and which supports a strip 28 which is parallel to the front. An elongated slot 27 is formed between strip 28 and wall 26 of the support member leaving narrow support legs **26*a* at the ends of strip 28, perpendicular to the plane of strip 28. A smaller elongated slot 29 is provided in strip 28 for receiving a screw 31 or other fastener. Likewise, a bottom support member 30 for the base plate includes a perpendicular wall 32 and a parallel support strip 34 having an elongated slot 33 at their junction, leaving narrow support legs 30*a* at the ends of strip 34, perpendicular to the plane of strip 34. A shorter elongated slot 35 is provided in strip 34 for receiving a screw 31. Strips 28 and 34 provide a supporting structure for the switch-mounting plate 20 that protects the relationship between the switch and the bimetal from being disturbed by stresses developed when screws 31** are tightened.

Base plate 20 also has a vertical support plate 36 perpendicular to the front and adjacent a rectangular opening 38 in the base plate for receiving a switch 40 having an enclosure attached to plate 36 by bolts 41. Switch 40 has an actuating plunger 44 extending from the front thereof and is of the snap-switch type requiring only limited travel of the plunger for causing snap-switch actuation of the switching mechanism between "open" and "closed," and between closed and open positions.

A small heating resistor 50 is disposed across the front of switch housing 40 and is connected across the switch terminals by conductors 52 and 54 which connect with line conductors 56 and 58, respectively, for a power input terminal and a load terminal of the device.

A main bimetal element 60 is disposed parallel to base plate 20 and has an integral foot 62 offset from the rear surface thereof for engaging plunger 44 to actuate the snap-switch 40. Main bimetal 60 is the ambient temperature sensing element and is formed of an elongated sheet of bimetal having ends 64 and 66 and an integral upwardly turned post 68 near end 66 for engaging the surface of a cam 70 for adjustment of the set-point of the thermostat. The switch actuator 44 provides spring bias urging the bimetal to the right in FIG. 2, and biases post 68 against cam 70. Cam 70 includes a ridge 72 for positive actuation of the switch to hold the switch open regardless of the ambient temperature. Cam 70 is supported from base plate 20 by an internally threaded bushing 74. The end of bushing 74 is reduced in diameter, passed through base plate 20 and spun over at the rear to provide a fastening means 75 to restrain axial movement thereof and to frictionally lock it against rotation. Fastening means 75 also secures bushing 74 against tilting motion. A knob 78 having a pointer 79 is connected to the front of cam 70, for rotating the cam. The knob and cam are carried by a threaded shaft 76 extending through the bushing, providing for rotation of the cam and the knob. The advantages of internally threaded bushing 74 and threaded shaft 76 of the cam are more fully disclosed and claimed in an application Ser. No. 595,220 filed concurrently herewith by H. T. Hazleton.

A compensating tongue 80 of bimetal is cut from bimetal sheet 60 or formed integral therewith and has its high expansion metal facing in the same direction as main bimetal 60. The end 64 of ambient temperature sensing bimetal 60 is unitary with and carried by base 82 of compensating tongue 80 as a cantilever. The projecting end 86 of the compensating tongue extends toward the opposite end of bimetal 60, is fixed to switch 40 by screw 85 and contacts auxiliary heating resistor 50 for the maximum deflection of the tongue by both switch heat and by the resistor heat. Projecting end 86 includes a portion 84 adjacent resistor 50, bent approximately at right angles to the rest of the compensating bimetal tongue, adjacent resistor 50. A tab 87 is cut from compensating tongue 80 and bent down against auxiliary resistor 50 to improve the heat coupling of the compensating tongue to resistor 50 and for mechanical retention of the resistor. The close proximity of the compensating tongue 80 to switch 40 and the exposure of a large portion of its area to the switch and its attachment thereto closely heat-couples the compensating tongue to the switch. This thermal coupling is much closer than the incidental exposure of a small part of the distant ambient sensing bimetal 60 to switch heat. Since the high expansion sides of the compensating bimetal tongue 80 and the ambient sensing bimetal 60 face in the same direction, they bow or warp in the same direction, but act differentially on the switch since they are joined in mechanical series at the base of the tongue. The compensating tongue is also exposed to the ambient atmosphere and main bimetal 60 should, therefore, be substantially longer than the compensator to provide adequate response to ambient temperature changes.

Heat generated in switch 40 by current conduction tends to increase the bow or deflection of main bimetal 60 and thereby causes switch plunger 44 to be depressed and open the switch at an ambient temperature below the set-point. Bimetal tongue 80 raises or lowers the cantilevered end 64 of main bimetal 60 inwardly or outwardly responsive to the amount of heat generated in switch 40 to compensate for the effect of switch heat on the main bimetal. Compensating tongue 80 raises cantilevered end 64 of main bimetal 60 as the switch conducts for longer periods on a cold day and generates more heat within itself, which ensures that the ambient temperature in the room is maintained at the set-point.

The thermostat of FIGS. 1–3 is constructed to be mounted in an upright position with base 82 of bimetal tongue 80 at the top so that most of the bimetal tongue is located above the body of switch 40. In this orientation, convection currents of air entering at the bottom and heated by switch 40 will rise along the surfaces of bimetal tongue 80 for the best heat-coupling between the switch and the compensating bimetal tongue. A cover (not shown) having ventilating openings in the top and bottom engages the base plate for protectively enclosing the thermostat against the wall and allowing the convection of air through it from the room. Mounting supports 25 and 30 are illustrated in FIGS. 1 and 2. Only mounting support 25, however, is illustrated in detail in FIG. 3 and it will therefore be described in detail.

Support members 25 and 30 are formed integral with the area of base plate 20 which supports switch 40 from plate 36, cam 70 on shaft 74, and ambient temperature sensing bimetal element 60 from bimetal tongue 80 through the body of the switch 40. Support members 25 and 30 include stiffening parts 26 and 32, respectively, which are integral margins extending from the support area of base plate 20. These stiffening parts 26 and 32 in the preferred embodiment are bent rearward from base plate 20 at approximately a right angle so that they are substantially upright from the base plate. A pair of mounting strips 28 and 34 are connected to stiffening parts 26 and 32 of the support members by stress-isolating junctions **26*a* and 32*a*, respectively. In the preferred embodiment, junctions 26*a* and 32*a* are relatively narrow stress-isolating leg members which are formed integral with stiffening parts 26 and 32.**

In support member 25, a slot 27 is formed in stiffening part 26 adjacent support strip 28, which slot defines the stress-isolating legs **26*a* which connect stiffening part 26 with the support strip 28 as illustrated in FIG. 3. Stress-isolating junctions or legs 26*a* are, therefore, integral with stiffening part 26. A similar slot 33 is formed in stiffening part 32 adjacent support strip 34 for defining the stress-isolating junctions or legs 32*a* of support member 30. Stiffening parts 26 and 32 are formed of margins of opposite ends of the support area of a base plate 20** in the preferred embodiment, as illustrated.

A smaller slot 29, 35 is formed in each of the support strips 28 and 34 of support members 25 and 30 for loosely receiving attachment screws 31 which are used for mounting the thermostat base to an electrical outlet box in a wall. These attachment screws 32 may be loosely retained in support strips 28 and 34 by fibre washers, if desired, as illustrated. Slots 29 and 35 allow some tolerance with respect to the alignment between the thermostat body and the electrical outlet box. An opening 86 is formed in the base 82 of compensating bimetal element 80 near the top of the thermostat for allowing access to attachment screw 31 for ease in mounting the thermostat.

Support strips 28 and 34 of the support members 25 and 30 are generally parallel to and offset from the plane of base plate 20 by stiffening parts 26 and 32 as illustrated. When the attachment screws 31 are tightened to the electrical outlet box during installation, support strips 28 and 34 are free to deform or bow between their connections to stiffening parts 26 and 32 by stress-isolating junctions or legs **26*a* and 32*a*. When support strips 28 and 34 are bowed or bent inwardly by the tightening force of attachment screws 31, the stress-isolating legs 26*a* and 32*a* deform slightly also. Stiffening parts 26 and 32, however, are little effected by the tightening force so that no distortion or warping of the support area of base plate 20 will occur. The tightening of the attachment screws 31 will, therefore, not distort the support plane of base plate 20 and not affect either the calibration or the sensitivity of the operative elements of the thermostat which include switch 40, bimetal elements 60 and 80 and the cam 70. The basic rigidity of base plate 20 is assured by the angled edges 22 and 23, and by the right angle bracket 36 which supports switch 40 and by the right angled stiffening parts 26 and 32 of the support members 25 and 30. Support plate 20** may, therefore, be formed of thinner sheet metal stock then would otherwise be possible or may be formed of a plastic material, either in sheet form or as a molded part. This structure therefore provides a stable mounting support for the thermostat, as well as providing a means for mounting the thermostat, which will not unduly stress and thereby disturb the calibration or sensitivity of the thermostat or other device with which it is utilized.

What we claim is:

1. A thermostat having a base plate including as integral portions thereof a support area, stiffening parts, a pair of mounting strips and pairs of stress-isolating junctions, an ambient temperature sensor, and a switch controlled by the ambient temperature sensor, said switch and ambient temperature sensor being carried by said support area of the base plate in calibrated relationship to each other, said stiffening parts extending upright from the support area of the base plate, said pairs of mounting strips extending parallel to and offset from the support area of the base plate, and a respective one of said pairs of stress-isolating junctions connecting the respective mounting strips proximate the ends thereof to different ones of the stiffening parts of the base plate.

2. A thermostat as in claim 1, wherein the stiffening parts of the base plate comprise margins extending from opposite ends of the support area of the base plate.

3. A thermostat as in claim 1, wherein the stiffening parts of the base plate extend rearward from the support area of the base plate and the stress-isolating junctions are integral with the stiffening parts.

4. A thermostat as in claim 1, wherein the stress-isolating junctions comprise narrow stress-isolating legs extending from the stiffening parts of the base plate, there being a slot formed in the adjacent stiffening parts between said legs.

5. A thermostat as in claim 1, wherein the ambient temperature sensor comprises a bimetal element and the switch is a snap-switch.

6. An instrument having a base plate including as integral portions thereof a supporting area, stiffening parts, a pair of mounting strips, and pairs of stress-isolating junctions, actuating means and a pair of electrical contacts controlled by the actuating means, said contacts and the actuating means being carried by a support area of the base plate in calibrated relationship to each other, said stiffening parts extending upright from the support area of the base plate, and a respective one of said pairs of stress-isolating junctions connecting the respective mounting strips proximate the ends thereof to different ones of the stiffening parts of the base plate.

7. Apparatus as in claim 6, wherein said stiffening parts of the base plate comprise marginal areas extending from opposite ends of the support area of the base plate.

8. Apparatus as in claim 6, wherein said stiffening parts of the base plate extend rearward from the support area of the base plate and the stress-isolating junctions are integral with the stiffening parts.

9. Apparatus as in claim 6, wherein the stress-isolating junctions comprise narrow stress-isolating legs extending from the stiffening parts of the base plate, there being a slot formed in the adjacent stiffening parts between the legs.

10. Apparatus as in claim 6, wherein said actuating means comprises an ambient temperature sensor and the electrical contacts comprise part of a snap-switch.

* * * * *